US007458666B2

(12) United States Patent
Momose

(10) Patent No.: US 7,458,666 B2
(45) Date of Patent: Dec. 2, 2008

(54) LIQUID EJECTION APPARATUS AND LIQUID FILLING METHOD FOR LIQUID EJECTION APPARATUS

(75) Inventor: Kaoru Momose, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 380 days.

(21) Appl. No.: 11/333,510

(22) Filed: Jan. 18, 2006

(65) Prior Publication Data

US 2006/0176346 A1 Aug. 10, 2006

(30) Foreign Application Priority Data

Jan. 19, 2005 (JP) ..... 2005-012047

(51) Int. Cl.
*B41J 2/175* (2006.01)
*B41J 2/165* (2006.01)

(52) U.S. Cl. ..... 347/85; 347/30

(58) Field of Classification Search ..... 347/5, 347/22, 23, 29, 30, 85, 92
See application file for complete search history.

(56) References Cited

U.S. PATENT DOCUMENTS 5,030,973 A * 7/1991 Nonoyama et al. ..... 347/93
5,943,078 A * 8/1999 Nishimoto et al. ..... 347/89
6,036,299 A * 3/2000 Kobayashi et al. ..... 347/30
6,220,700 B1 4/2001 Haigo
6,517,189 B2 * 2/2003 Ogawa et al. ..... 347/35
6,846,062 B2 * 1/2005 Harada et al. ..... 347/30
2003/0016265 A1 1/2003 Harada et al.

FOREIGN PATENT DOCUMENTS

EP 0 609 863 A2 8/1994
EP 1 288 000 A2 3/2003
JP 2003-211688 A 7/2003
JP 2004-58398 A 2/2004

* cited by examiner

*Primary Examiner*—Anh T. N. Vo
(74) *Attorney, Agent, or Firm*—Sughrue Mion, PLLC

(57) ABSTRACT

In a first intense suction, a supply line K is subjected to suction by a suction pump 23 with a portion of the supply line K held in a blocked state. Subsequently, the blocked portion of the supply line K is opened and trapped bubbles are discharged from a pressure chamber 46, which is located relatively upstream. In a subsequent second intense suction, the suction by the suction pump 23 is performed on the supply line K with a portion of the supply line K held in a blocked state, until a maximum negative pressure smaller than a maximum negative pressure of the first intense suction is obtained. The blocked portion of the supply line K is then opened, thus discharging trapped bubbles from an upper filter chamber 64, which is located relatively downstream.

10 Claims, 5 Drawing Sheets

LIQUID EJECTION APPARATUS AND LIQUID FILLING METHOD FOR LIQUID EJECTION APPARATUS

BACKGROUND OF THE INVENTION

The present invention relates to liquid ejection apparatuses ejecting liquid as droplets through liquid ejection heads, such as inkjet recording apparatuses, display manufacturing apparatuses, electrode manufacturing apparatuses, and biochip manufacturing apparatuses, and liquid filling methods for these apparatuses.

Conventionally, inkjet printers are known as liquid ejection apparatuses that eject liquid droplets through nozzles of an ejection head. There are some inkjet printers (hereinafter, "printers") that include "off-carriage" type ink supply systems. One such system includes an ink retainer retaining the ink as liquid that is installed outside a carriage of the printer.

As described in Japanese Laid-Open Patent Publication No. 2003-211688, for example, the ink supply system may include an ink supply line that extends from an ink cartridge to an ejection head formed in the carriage. The supply line includes a pressure adjustment mechanism as well as a tubular passage.

Typically, the pressure adjustment mechanism is formed by, for example, a self-sealing valve having a pressure adjustment valve and a pressure chamber. A choke valve is arranged between the pressure adjustment mechanism and the ink cartridge in the supply line.

Before the initial use of such a printer, initial ink filling is performed for charging the ink into the supply line. More specifically, a nozzle surface of an ejection head is sealed by a cap and, in this state, the interior of the cap is depressurized. This draws the ink from the ink cartridge into the supply line, thus filling the line.

When the initial ink filling is performed on the printer, it is crucial that the ink be supplied to the supply line without forming bubbles (an air layer) in the supply line.

However, the supply line includes enlarged portions such as the pressure chamber of the pressure adjustment mechanism and a head filter chamber. Each of these enlarged portions has an enlarged communication area compared to that of the tubular passage. This may facilitate formation of the bubbles (the air layer) in the enlarged portions, thus hampering the initial ink filling into the supply line.

To solve this problem, the initial ink filling involves choke suction. The choke suction is performed with a choke valve held in a closed state (in a choked state). This increases the negative pressure acting in a downstream section of the supply line from the choke valve. The air is thus removed from the pressure chamber or the like in the supply line. At this stage, by opening the choke valve, the ink is efficiently charged into the supply line.

Nonetheless, by such choke suction, the bubbles that have been removed from the pressure chamber of the pressure adjustment mechanism may be re-trapped in the head filter chamber located downstream from the pressure chamber. In this case, by repeating the choke suction to obtain an equal level of negative pressure to that of the previous choke suction, the trapped bubbles can be removed from the head filter chamber through an ejection head. However, the repeated choke suction may again remove the bubbles from the pressure chamber and then re-trap these bubbles in the head filter chamber.

The amount of the bubbles trapped in the pressure chamber of the pressure adjustment mechanism can be decreased by repeating the choke suction. However, in order to reduce the bubbles trapped in the head filter eventually to a level necessary for maintaining the printing quality, the choke suction must be repeated for multiple times, wasting an excessive amount of ink. This hampers efficient filling of the ink, or the liquid.

Similar problems occur in different types of liquid ejection apparatuses ejecting liquid as droplets by ejection heads, other than the printers, as long as the apparatuses include an enlarged portion having a communication area larger than that of the tubular passage. These apparatuses include display manufacturing apparatuses, electrode manufacturing apparatuses, and biochip manufacturing apparatuses.

SUMMARY OF THE INVENTION

Accordingly, it is an objective of the present invention to provide a liquid ejection apparatus and a liquid filling method for the apparatus that permit an efficient liquid filling, without wasting an excessive amount of liquid.

To achieve the foregoing and other objectives and in accordance with the purpose of the present invention, a first aspect of the invention provides a method for charging liquid into a supply line defined in a liquid ejection apparatus. The supply line supplies the liquid from a liquid retainer retaining the liquid to a nozzle ejecting the liquid. The supply line includes a tubular passage and a plurality of enlarged portions that communicate with the tubular passage. The liquid ejection apparatus has suction means that draws gas or liquid from the supply line through the nozzle. The method includes a first suction step of performing suction by the suction means with a portion of the supply line held in a blocked state at a predetermined position and then releasing the blocked portion of the supply line, whereby discharging a bubble from an upstream one of the enlarged portions. The method further includes a second suction step of performing the suction by the suction means after the first suction step with the portion of the supply line held in the blocked state at the predetermined position till obtaining a maximum negative pressure smaller than a maximum negative pressure of the first suction step in the supply line and then releasing the blocked portion of the supply line after completing the suction by the suction means, whereby discharging a bubble from a downstream one of the enlarged portions.

The supply line includes a supply tube that connects the liquid retainer to an ejection head, a joint portion between the ejection head and the supply tube, and communication passages provided in correspondence with different types of liquid and different nozzles.

Each of the enlarged portions is defined as an enlarged line section that communicates with the tubular passage. The enlarged portions include, for example, a pressure chamber of a pressure adjustment valve provided in the supply tube and a head filter chamber. The structure of each enlarged portion in the supply line makes it difficult to remove bubbles (an air layer) from the enlarged portion. It is rarely possible to completely fill the supply line with the liquid through a single cycle of suction. More specifically, by raising the flow rate of the liquid during the suction, the amount of the liquid passing through each enlarged portion can be increased. However, after a certain time, a stationary flow may occur in the vicinity of the bubbles, making it difficult to further remove the bubbles from the enlarged portions.

In a conventional initial liquid filling, the liquid is first charged into the entire supply line. Subsequently, a multiple cycles of suctions are repeatedly carried out for discharging the remaining bubbles. Each of the suction cycles involves choke suction followed by opening of the supply line. In every suction cycle, the supply line is switched to the open state for performing the suction when the negative pressure reaches equal values (equal maximum negative pressures).

In this case, the amount of the bubbles trapped in an upstream one of the enlarged portion decreases through the suction cycles, or removal of the bubbles from the supply line. However, although some of the bubbles are discharged from a downstream one of the enlarged portions, the bubbles from the upstream enlarged portion are re-trapped in the downstream enlarged portion. In other words, the amount of the bubbles trapped in the downstream enlarged portion cannot be reduced unless the amount of the bubbles discharged from the upstream enlarged portion decreases. Further, the ejection head cannot eject liquid droplets effectively unless the bubbles trapped in the downstream enlarged portion decreases to a certain extent. Thus, to sufficiently reduce the bubbles trapped in the downstream enlarged portion, the suction cycles must be performed repeatedly, wasting an excessive amount of the liquid.

In contrast, in the second suction step of the method for the present invention, the suction by the suction means is performed till obtaining the maximum negative pressure that is lower than that of the first suction step, with the portion of the supply line held in the blocked state.

That is, in the first suction step, the maximum negative pressure acts to cause a rapid liquid flow in the supply line for discharging some of the bubbles from the upstream enlarged portion. At this stage, a certain amount of the bubbles remain in the upstream enlarged portion without being discharged. On the other hand, the maximum negative pressure of the first suction step acts to remove some bubbles from the downstream enlarged portion. However, the downstream enlarged portion re-traps the bubbles that have been discharged from the upstream enlarged portion.

In the subsequent second suction step, the maximum negative pressure that acts to draw the bubbles from the supply line is smaller than that of the first suction step. The bubbles trapped in the upstream enlarged portion thus remain in the upstream enlarged portion without being discharged. However, the maximum negative pressure of the second suction step is sufficiently high for removing the bubbles that have been re-trapped in the first suction step from the downstream enlarged portion, as caught in a rapid liquid flow. Since the bubbles are not removed from the upstream enlarged portion in the second suction step, the downstream enlarged portion does not receive any more bubbles. The amount of the bubbles trapped in the downstream enlarged portion is thus reduced.

As a result, the liquid is efficiently charged into the supply line without wasting an excessive amount of the liquid.

A second aspect of the present invention provides a liquid ejection apparatus that has a supply line for supplying a liquid from a liquid retainer retaining the liquid to a nozzle ejecting the liquid, an open-close device for selectively opening and closing a portion of the supply line, a suction device for drawing a gas or the liquid from the supply line through the nozzle, and a controller for controlling the open-close device and the suction device. The supply line includes a tubular passage and a plurality of upstream and downstream enlarged portions that communicate with the tubular passage. In the apparatus, the controller performs suction at a first negative pressure by the suction device with a portion of the supply line maintained in a blocked state by the open-close device and then releases the blocked portion of the supply line through the open-close device. Subsequently, the controller performs the suction by the suction device with the portion of the supply line maintained in the blocked state by the open-close device till obtaining a second negative pressure smaller than the first negative pressure and then releases the blocked portion of the supply line through the open-close device.

Thus, the first maximum negative pressure acts to remove the bubbles from the upstream enlarged portion. Further, the second maximum negative pressure acts to remove the bubbles from the downstream enlarged portion without discharging the bubbles from the upstream enlarged portion.

Accordingly, in the second suction step, the bubbles remain in the upstream enlarged portion without being discharged. Thus, the downstream enlarged portion does not receive any more bubbles from the upstream enlarged portion. The amount of the bubbles trapped in the downstream enlarged portion thus decreases. As a result, the liquid filling is performed efficiently without wasting an excessive amount of the liquid.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A printer having an off-carriage type ink supply system of a preferred embodiment of a liquid ejection apparatus according to the present invention will now be described with reference to FIGS. 1 to 6.

Figure 1:
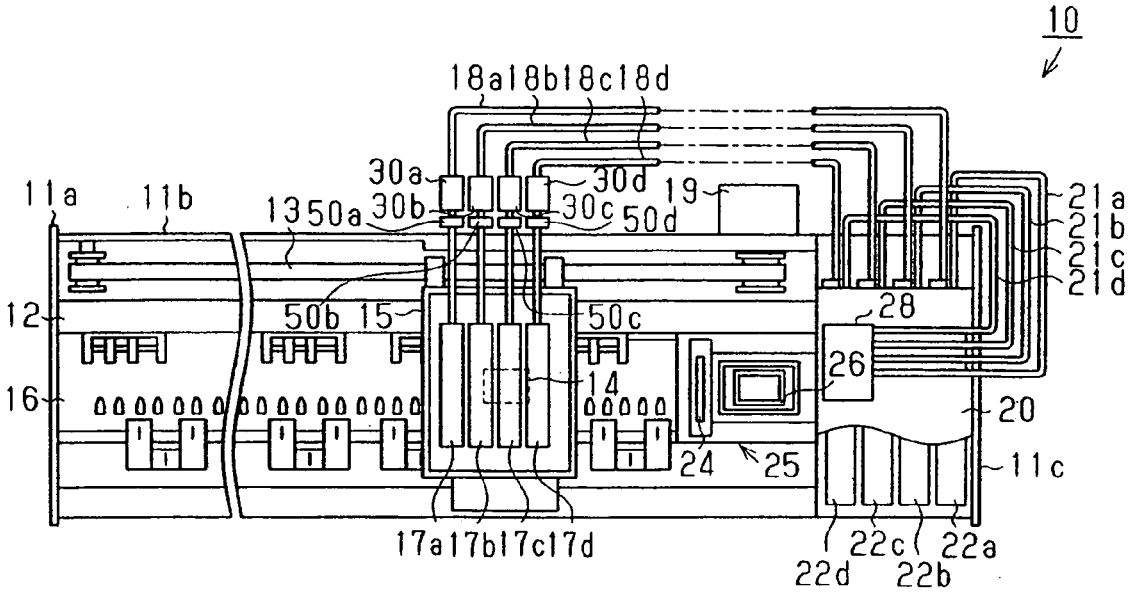
FIG. 1 is a plan view schematically showing a liquid ejection apparatus according to a first embodiment of the present invention.

As shown in FIG. 1, a printer 10 includes frames 11*a*, 11*b*, 11*c*. A platen 16 is provided in the space defined by the frames 11*a* to 11*c*. The platen 16 supports a recording medium such as a sheet of paper. The ink, or liquid, is ejected onto the recording medium at the position supported by the platen 16.

A carriage 15 including an ejection head 14 is arranged at a position opposed to the platen 16. The carriage 15 is supported by a carriage guide rod 12 secured to the inner sides of the frames 11*a*, 11*c*. A carriage drive motor 19 drives the carriage 15 through a belt 13 in such a manner that the carriage 15 reciprocates along the guide rod 12. The ejection head 14, which is formed in the carriage 15, ejects the ink while moving relative to the recording medium. In this manner, printing is performed in a desired manner.

The printer 10 performs color printing using different types of color inks, which are, for example, black, magenta, cyan, and yellow inks. Each of the four inks is retained in a corresponding one of ink cartridges 22*a*, 22*b*, 22*c*, 22*d*, which are liquid retainers separably secured to the frames 11*a* to 11*c*. In this state, the ink cartridges 22*a* to 22*d* are installed in a cartridge holder 20, as viewed to the right in FIG. 1. Supply tubes 18*a*, 18*b*, 18*c*, 18*d* are connected to the corresponding ink cartridges 22*a*, 22*b*, 22*c*, 22*d* and thus project from the cartridge holder 20. The supply tubes 18*a*, 18*b*, 18*c*, 18*d* are also connected to pressure adjustment mechanisms 17*a*, 17*b*, 17*c*, 17*d*, respectively, through corresponding choke valves 30*a*, 30*b*, 30*c*, 30*d* and upstream filter chambers 50*a*, 50*b*, 50*c*, 50*d*. The pressure adjustment mechanisms 17*a* to 17*d* are provided in the carriage 15. Each of the upstream filter chambers 50*a* to 50*d* includes a filter 52 and infiltrates the ink by the filter 52.

Each of the pressure adjustment mechanisms 17*a* to 17*d* is connected to the ejection head 14 through a communication passage 27 and a filter unit 60. The ink is thus supplied from each of the ink cartridges 22*a* to 22*d* to the ejection head 14 and ejected from a nozzle 33 (FIG. 2) as droplets.

Figure 2:
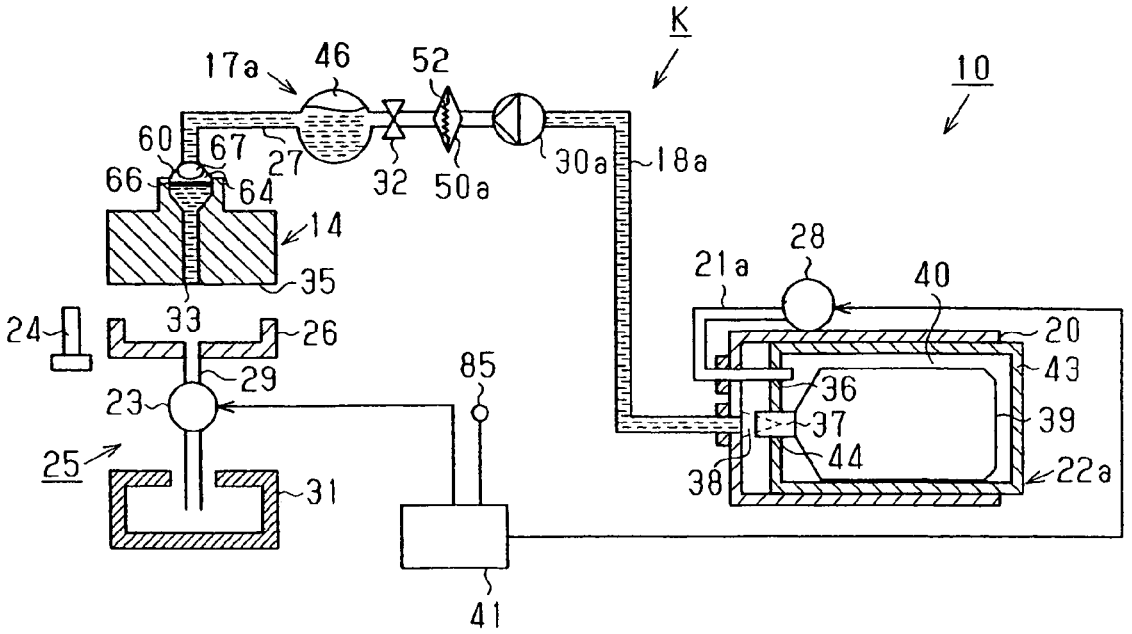
FIG. 2 is a diagram schematically representing a supply system and a waste system of a printer.

As shown in FIGS. 1 and 2, the printer 10 includes a pressurization pump unit 28 formed in the cartridge holder 20. The pressurization pump unit 28 supplies the compressed air into each of the ink cartridges 22*a* to 22*b* through a corresponding one of vent tubes 21*a*, 21*b*, 21*c*, 21*d* and the cartridge holder 20. The pressurization pump unit 28 includes, for example, a diaphragm pump and a pressure adjustment regulator for adjusting the pressure in each of the ink cartridges 22*a* to 22*d*.

Referring to FIG. 1, the printer 10 includes a maintenance unit 25, as viewed to the right with respect to the platen 16 in FIG. 1. The maintenance unit 25 has a cap 26 and a wiper 24. The cap 26 seals a nozzle surface 35 (see FIG. 2) of the ejection head 14 and prevents nozzle clogging before the initial use of the printer 10. The cap 26 is employed also when suction is performed. That is, the suction is accomplished by depressurizing the interior of the cap 26 with the nozzle surface 35 sealed by the cap 26. This draws and removes undesirable objects and bubbles from the nozzles, together with the ink. The wiper 24 wipes off the liquid from the nozzle surface 35 of the ejection head 14, after completion of the suction, for example.

An ink supply system and a waste system of the printer 10 will hereafter be explained with reference to FIGS. 2 to 5. FIG. 2 is a diagram schematically showing the ink supply system and the waste system of the printer 10. In the following, the description focuses on the ink supply system and the waste system of the ink cartridge 22*a*. However, the ink supply systems and the waste systems of the other ink cartridges 22*b* to 22*d* are configured identically with those of the ink cartridge 22*a*, and explanation thereof will thus be omitted.

As shown in FIG. 2, the ink cartridge 22*a* includes a casing 43 formed of, for example, plastic and an ink pack 39 accommodated in the casing 43. The ink pack 39 is formed by welding a flexible film in a pack-like shape.

Ink is retained in the ink pack 39 and introduced to the exterior through an outlet portion 37. The outlet portion 37 has a distal end projecting from a through hole 44 defined in the casing 43 to the exterior. The distal end of the outlet portion 37 is separably joined with a joint portion 38 formed in an inner side of the cartridge holder 20. The joint portion 38 is formed as a hollow needle-like member and communicates with the supply tube 18*a*. Further, a vent hole 36 is defined in the casing 43 of the ink cartridge 22*a* and receives one end of the vent tube 21*a*.

With the ink cartridge 22*a* installed in the cartridge holder 20, the outlet portion 37 is joined with the joint portion 38. Further, the corresponding end of the vent tube 21*a* is passed through the vent hole 36 and thus projects into an interior 40 of the casing 43.

In this state, the interior 40 of the ink cartridge 22*a* is maintained in an airtight state. When the compressed air is introduced from the pressurization pump unit 28 into the ink cartridge 22*a* via the vent tube 21*a*, a pressure rise occurs in the interior 40 of the ink cartridge 22*a*. This pressurizes the ink in the ink pack 39 through a film surface of the ink pack 39. The ink is thus supplied in a pressurized state to the supply tube 18*a* through the outlet portion 37 and the joint portion 38. The air supply pressure of the pressurization pump unit 28 is controlled by a controller 41. In other words, the controller 41 controls the supply pressure of the ink.

The choke valve 30*a* is provided in the supply tube 18*a*. The choke valve 30*a* corresponds to open-close means that selectively opens and closes the supply tube 18*a*.

The choke valve 30*a* opens when the ink supply pressure of the ink cartridge 22*a* is higher than or equal to a predetermined value. This causes the ink to flow to the pressure adjustment mechanism 17*a* through the upstream filter chamber 50*a*. If the ink supply pressure of the ink cartridge 22*a* is lower than the predetermined value, the choke valve 30*a* closes and thus blocks the ink flow to the pressure adjustment mechanism 17*a*. In this manner, the choke valve 30*a* is operated as an open-close valve by controlling the ink supply pressure of the ink cartridge 22*a*. That is, the choke valve 30*a* and the controller 41, which controls the ink supply pressure, cooperate to selectively permit and prohibit (choke) the ink supply.

The pressure adjustment mechanism 17*a* is configured as a self-sealing valve having a pressure adjustment valve 32 and a pressure chamber 46.

The ink is supplied from the ink cartridge 22*a* to the pressure adjustment mechanism 17*a* through the upstream filter chamber 50*a* and the choke valve 30*a*. At this stage, the ink supply pressure applied to the pressure adjustment mechanism 17*a* is higher than the atmospheric pressure. Thus, if the ink reaches the ejection head 14 under this pressure, the ink may leak from the nozzle 33 of the ejection head 14, hampering appropriate ejection controlling. To avoid this, the pressure adjustment valve 32 of the pressure adjustment mechanism 17*a* depressurizes the ink. The pressure in the pressure chamber 46 is thus adjusted in such a manner that the ink pressure in the nozzle 33 becomes a suitable level of negative pressure (with respect to the atmospheric pressure).

The pressure adjustment mechanism 17*a* will hereafter be explained.

Figure 3:
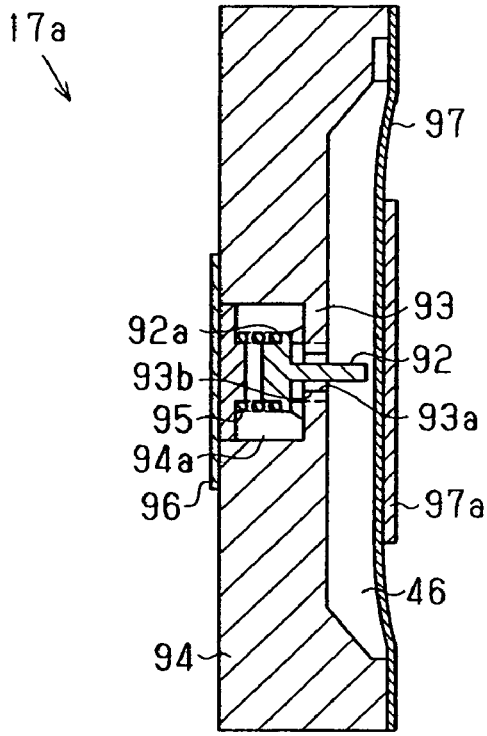
FIG. 3 is a cross-sectional view showing a pressure adjustment mechanism.

FIG. 3 is a cross-sectional view showing the pressure adjustment mechanism 17*a* by way of example. As shown in the drawing, the pressure adjustment valve 32 includes a valve body 92 having a substantially T shaped cross-sectional shape. A portion of the valve body 92 is passed through a through hole 93*a* defined in a partition wall 93. The valve body 92 is thus movably supported by a casing 94. The valve body 92 has a contact portion 92*a* that may be held in contact with a seal portion 93*b*, or an opening end of the through hole 93*a*. A spring 95 constantly urges the valve body 92 in a direction in which the contact portion 92*a* contacts the seal portion 93*b*. Film members 96, 97 are secured to the casing 94 at opposing ends of the valve body 92. The film member 96 seals an ink supply chamber 94*a* defined in the casing 94. The film member 97 seals a pressure chamber 46, which is also defined in the casing 94. A pressure receiving plate 97*a* is secured to the film member 97 as opposed to the valve body 92. The ink supply chamber 94*a* is connected to the supply tube 18*a* and thus receives the ink from the supply tube 18*a*. The pressure chamber 46 communicates with the communication passage 27. The ink thus flows from the pressure chamber 46 to the exterior through the communication passage 27.

When the printer 10 is not in printing operation, the urging force of the spring 95 and the ink pressure in the ink supply chamber 94*a* are applied to the valve body 92. This maintains the pressure adjustment valve 32 in a closed state.

In this state, if the ink is supplied to the ejection head 14 through the communication passage 27, the pressure in the pressure chamber 46 decreases. The resulting difference between the pressure in the pressure chamber 46 and the atmospheric pressure deforms the film member 97 inwardly. This causes the pressure receiving plate 97*a* to contact the valve body 92. As the aforementioned pressure difference becomes greater, the pressing force applied by the pressure receiving plate 97*a* to the valve body 92 becomes greater. When the pressure difference exceeds a predetermined value, the pressing force of the pressure receiving plate 97*a* becomes greater than the urging force of the spring 95. This separates the contact portion 92*a* from the seal portion 93*b* (an open-valve state). The ink thus flows from the ink supply chamber 94*a* to the pressure chamber 46 to compensate the pressure in the pressure chamber 46. The valve body 92 is thus returned to a closed state. That is, the pressure in the pressure chamber 46 is maintained at a constant level through operation involving the closed state of the pressure adjustment valve 32, the depressurization of the pressure chamber 46, the open state of the pressure adjustment valve 32, the pressure compensation of the pressure chamber 46, and, again, the valve closed state, which are repeated in this order.

After the ink pressure is adjusted to an appropriate level by the pressure adjustment mechanism 17*a*, the ink flows to a segment passage 45 through the communication passage 27 and the filter unit 60. The segment passage 45 includes a cavity defined in correspondence with each nozzle. The ink is then subjected to ejection or suction and thus ejected or drained from the nozzle 33. Further, although the ejection head 14 actually includes multiple communication passages 27, multiple segment passages 45, and the nozzles 33, the drawings each illustrate the single communication passage 27, the single segment passage 45, and the single nozzle 33, for the illustrative purposes.

Figure 4:
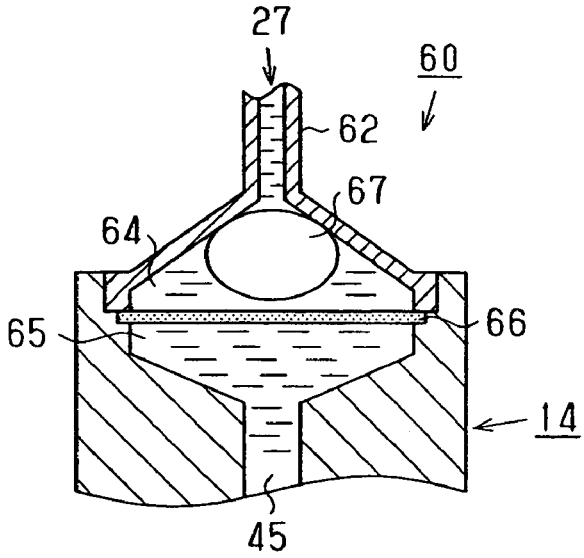
FIG. 4 is a cross-sectional view showing a filter unit.

As shown in FIG. 4, the filter unit 60 is arranged in a line extending from a hollow needle 62 to the segment passage 45. The filter unit 60 has an upper filter chamber 64 having a downwardly tapered shape and a lower filter chamber 65 having an upwardly tapered shape. A filter plate 66 is arranged between the filter chambers 64, 65. The taper angle of each of the upper and lower filter chambers 64, 65 with respect to the filter plate 66 is set to approximately 30 to 60 degrees. The filter unit 60 receives and removes undesirable objects from the ink supplied to the ejection head 14 and traps a bubble 67 from the ink. The undesirable objects and the bubble 67 are thus stopped from entering the ejection head 14. Each of the filter chambers 64, 65 of the filter unit 60 is sized larger than the communication area of the communication passage 27. This suppresses pressure loss caused by the ink passing through the filter chambers 64, 65. The total volume of the upper and lower filter chambers 64, 65 is smaller than the volume of the pressure chamber 46.

If the trapped bubble 67 interferes with the filter plate 66, the ink cannot pass through the portion of the filter plate 66 corresponding to the bubble 67. Thus, to solve this problem, each filter chamber 64, 65 of the filter unit 60 is shaped in such a manner as to prevent the trapped bubble 67 from interfering with the filter plate 66. The upper filter chamber 64 having a cone-like shape thus traps the bubble 67 as held in contact with an upper inner wall of the upper filter chamber 64. The bubble 67 is thus prevented from interfering with the filter plate 66 unless the bubble 67 becomes relatively large.

As has been described, the supply line K includes tubular passages such as the supply tube 18*a* and the communication passage 27 and enlarged portions such as the pressure chamber 46 of the pressure adjustment mechanism 17*a* and the upper filter chamber 64 of the filter unit 60. The cross-sectional area of each of the enlarged portions is greater than the communication area of each of the tubular passages.

The pressure chamber 46, or one of the enlarged portions, includes a portion that facilitates formation of bubbles (an air layer). This makes it difficult to remove the bubbles from the pressure chamber 46. When the printer 10 is in printing operation, the bubbles may flow from the pressure chamber 46 to the ejection head 14 and hamper the ink ejection. Accordingly, when the ink filling is performed as will be described in the following, it is desired that the ink be reliably supplied to the supply line K, preferably without forming the bubbles in the pressure chamber 46.

Figure 5:
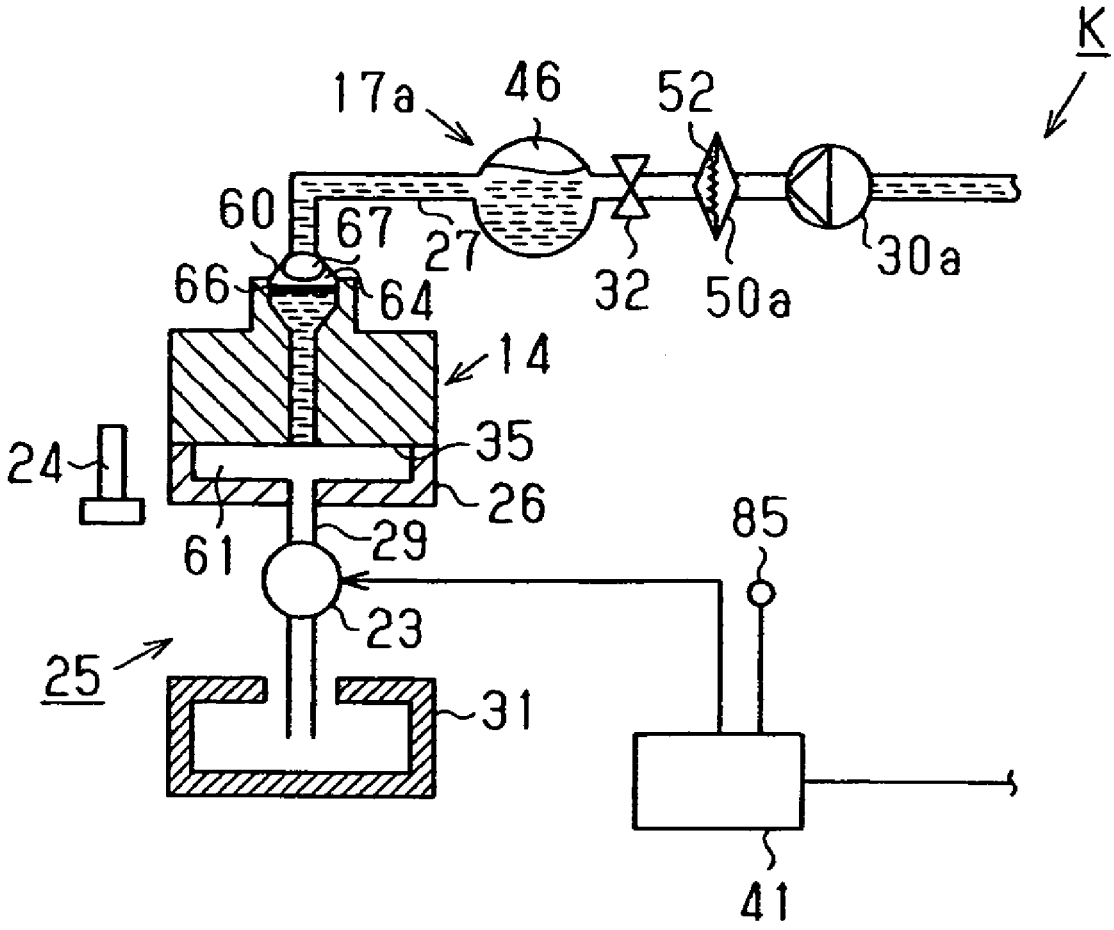
FIG. 5 is a diagram schematically representing a supply system and a waste system of a printer.

As shown in FIG. 5, the maintenance unit 25 is a main structure of the waste system of the printer 10. The maintenance unit 25 includes the cap 26, a waste tube 29, a suction pump 23, a waste tank 31, and the wiper 24. The cap 26 seals the nozzle surface 35 of the ejection head 14 and has a through hole extending through the center of the cap 26. The waste tube 29 communicates with the through hole of the cap 26. The suction pump 23 is provided in the waste tube 29. The waste tank 31 is connected to the distal end of the waste tube 29. The wiper 24 is formed by, for example, a rubber blade. The suction pump 23 is formed by, for example, a tube pump controlled by the controller 41.

When suction is performed, the nozzle surface 35 is sealed by the cap 26. In this state, the suction pump 23 is continuously operated to depressurize an interior 61 of the nozzle 33, which is a sealed space. This draws the ink from the nozzle 33. In other words, the cap 26, the waste tube 29, and the suction pump 23 form suction means.

At this stage, if the choke valve 30*a* is held in an open state, the ink is continuously charged into the supply line K and thus constantly flows in the supply line K.

In contrast, if the choke valve 30*a* is maintained in a closed state, the ink flow from the nozzle 33 stops relatively soon. A relatively great negative pressure (pressure of a low absolute value) is thus generated in the pressure chamber 46 and the communication passage 27. If the choke valve 30*a* is opened in this state, a rapid ink flow is caused and thus the bubbles are effectively drained from the supply line K. Hereinafter, "intense suction" refers to a suction mode in which suction is started with the supply line K held in the closed state and then the supply line K is opened for causing a rapid ink flow. Contrastingly, "normal suction" refers to a suction mode in which suction is started with the supply line K held in the open state, not in the closed state.

Referring to FIG. 5, the initial ink filling of the printer 10 will be explained. The initial ink filling is performed before the initial use of the printer 10. More specifically, in the initial ink fill, the ink is introduced from the ink cartridges 22*a* to 22*d* into the supply line K.

In this embodiment, the initial ink filling includes the normal suction, a first intense suction, and a second intense suction.

Prior to the initial ink fill, the supply line K of the printer 10 may or may not contain a preservative liquid (which is originally charged into the supply line K). If the supply line K does not contain the preservative liquid, the supply line K is empty or retains a gas. In the first embodiment, the supply line K originally contains the gas.

Since the supply like K is empty when the initial ink filling is performed in the first embodiment, the ink is introduced into the supply line K through the normal suction. That is, the choke valve 30*a* is maintained in the open state by controlling the ink supply pressure with the controller 41. In this state, the interior of the nozzle 33 sealed by the cap 26 is depressurized, thus drawing the gas and the ink from the supply line K.

Through the normal suction, the pressure chamber 46 of the pressure adjustment mechanism 17*a* is preliminarily filled with the ink. In this preliminary filling, the head (the meniscus) of the ink may be located at any suitable position as long as the position is located downstream from the pressure chamber 46 in the supply line K. In the first embodiment, through the normal suction, the head of the ink reaches a portion in the segment passage 45 of the ejection head 14. At this stage, the pressure chamber 46 of the pressure adjustment mechanism 17*a* and the upper filter chamber 64 of the filter unit 60 are not yet completely filled with the ink and thus contain bubbles. Subsequently, the first intense suction is performed relatively soon after the normal suction.

The first intense suction is executed by the controller 41 as a first suction step. More specifically, by controlling the ink supply pressure, the controller 41 maintains the choke valve 30*a* in the closed state. Meanwhile, the controller 41 operates the suction pump 23. This depressurizes the interior 61 of the nozzle 33 sealed by the cap 26, thus drawing the air and/or the ink from the supply line K. A pressure sensor 85 detects the negative pressure in the supply line K. In correspondence with a detection value of the pressure sensor 85, the controller 41 determines whether or not the negative pressure in the interior 61 of the cap 26 reaches a certain level, or a constant negative pressure (a maximum negative pressure P1 of the first suction step). The maximum negative pressure P1 corresponds to a first maximum negative pressure.

If it is determined that the negative pressure in the interior 61 of the cap 26 reaches the constant negative pressure, the controller 41 controls the ink supply pressure in such a manner as to open the choke valve 30*a*. Meanwhile, the controller 41 continuously operates the suction pump 23 and thus depressurizes the interior 61 of the nozzle 33. This draws the air and/or the ink from the supply line K. The time consumed for switching the choke valve 30*a* from the closed state to the open state is defined as time t1 (a closed-valve time), referring to FIG. 6. In this case, the maximum negative pressure P1 of the first suction step is set in such a manner that the amount of the bubbles trapped and held in the pressure chamber 46, or an upstream one of the enlarged portion, does not exceed a certain value. Further, in the first embodiment, the pressure sensor 85 detects the negative pressure in the supply line K. However, through experiments or the like, data may be obtained regarding the closed-valve time t1 that is necessary for decreasing the pressure in the interior 61 to the constant negative pressure. The controller 41 measures the time from when the suction pump 23 is started by a timer (not shown). When the measurement coincides with the time t1, the controller 41 stops the suction pump 23.

When the choke valve 30*a* is held in the open state, a rapid ink flow is caused by the difference between the negative pressure accumulated in the supply line K and the supply pressure acting in the upstream portion from the choke valve 30*a* in the supply line K. The ink suction from the supply line K is thus started at the maximum negative pressure P1. That is, the first suction step is executed under the maximum negative pressure P1. Some of the bubbles trapped in the pressure chamber 46, the upstream enlarged portion, are thus removed from the pressure chamber 46. Accordingly, a certain amount of bubbles remain in the pressure chamber 46 in correspondence with the maximum negative pressure P1.

Figure 6:
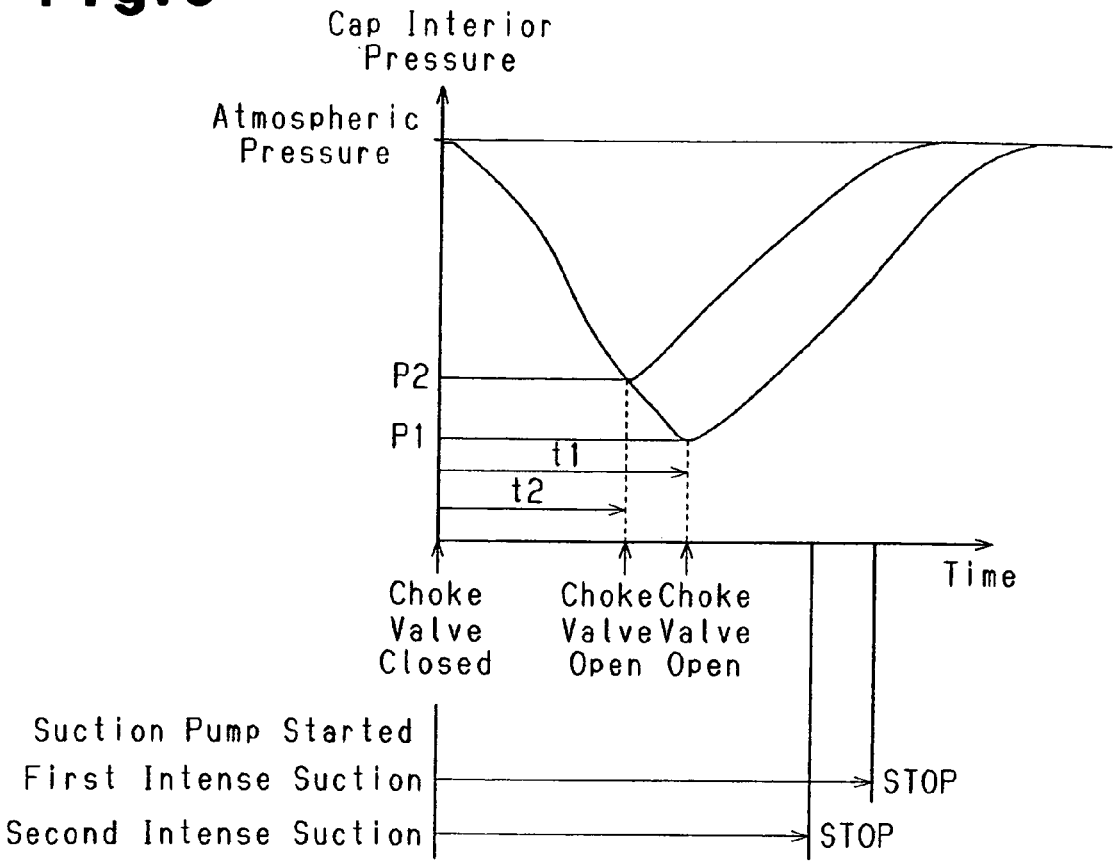
FIG. 6 is a graph representing variation of the pressure in a cap 26 and operation timings of a suction pump during first and second intense suctions.

Since the maximum negative pressure P1 acts also in the upper filter chamber 64, a downstream enlarged portion, some of the bubbles are discharged from the upper filter chamber 64. The loss of the bubbles is compensated by the bubbles discharged from the pressure chamber 46, located upstream from the upper filter chamber 64. Referring to FIG. 6, the controller 41 stops the suction pump 23 when a predetermined time elapses after the choke valve 30*a* is switched to the open state.

The second intense suction is started relatively soon after the first intense suction is completed as has been described.

The controller 41 performs the second intense suction as a second suction step. More specifically, the controller 41 first determines whether or not the choke valve 30*a* is held in the closed state. If the choke valve 30*a* is open, the controller 41 controls the ink supply pressure in such a manner as to close the choke valve 30*a*. Further, the controller 41 activates the suction pump 23 to depressurize the interior 61 of the nozzle 33, which is sealed by the cap 26. This draws the air and/or the ink from the supply line K.

The controller 41 then measures the time from when the choke valve 30*a* is switched to the closed state, by the timer. When the measurement coincides with time t2, which is shorter than the time t1, the controller 41 controls the ink supply pressure in such a manner as to open the choke valve 30*a*. In other words, the second intense suction shortens the time for maintaining the choke valve 30*a* in the closed state, or the time t2 (the time from when the choke valve 30*a* is closed to when the choke valve 30*a* is opened: the time for maintaining a portion of the supply line K in a blocked state), compared to that of the first intense suction. This decreases a maximum negative pressure P2 of the second intense suction compared to the maximum negative pressure P1 of the first intense suction. The maximum negative pressure P2 corresponds to a second maximum negative pressure. The second maximum negative pressure P2 corresponds to a negative pressure at which the bubbles are prevented from flowing out of the pressure chamber 46 but some of the bubbles are permitted to flow from the upper filter chamber 64. The second negative pressure is set through experiments carried out under predetermined conditions such as the suction speed of the suction pump 23 operated by the controller 41, the time t2, and the communication area of the supply line K (including the upper filter chamber 64 and the lower filter chamber 65).

With the choke valve 30*a* maintained in the open state, the controller 41 continuously controls and drives the suction pump 23 to depressurize the interior 61 of the nozzle 33 sealed by the cap 26. The air and/or the ink is/are thus drawn from the supply line K. In the first embodiment, the controller 41 operates the suction pump 23 at equal suction speeds in the first intense suction and the second intense suction. The controller 41 stops the suction pump 23 when a predetermined time elapses after the choke valve 30*a* is opened, with reference to FIG. 6.

As has been described, the maximum negative pressure P2 of the second intense suction is smaller than the maximum negative pressure P1 of the first intense suction. This prevents the bubbles trapped in the pressure chamber 46, the upstream enlarged portion, from being discharged from the pressure chamber 46 in the second intense suction. Contrastingly, in the second intense suction, the maximum negative pressure P2 acts to remove the bubbles that have been trapped in the first intense suction from the upper filter chamber 64, the downstream enlarged portion. In other words, the second intense suction prevents the bubbles from flowing from the pressure chamber 46, the upstream enlarged portion. The bubbles are thus stopped from flowing into the upper filter chamber 64, the downstream enlarged portion. This reduces the amount of the bubbles trapped in the upper filter chamber 64. In this manner, the liquid is efficiently charged into the supply line K, without wasting an excessive amount of the liquid.

In a liquid ejection apparatus having a relatively long supply line, like the supply line K of the off-carriage type printer 10 of the first embodiment, the movement resistance (the head loss) of the ink (the liquid) makes it difficult to obtain a sufficient flow rate of the ink (the liquid) for removing the bubbles. The above-described operation is particularly effective for such liquid ejection apparatuses.

In the first embodiment, after the suction is started by the suction pump 23, the negative pressure becomes gradually greater (the absolute value of the pressure is reduced) towards a maximum value in correspondence with the performance of the suction pump 23. Therefore, the controller 41 controls the maximum negative pressures through the suction pump 23 by controlling the time after the suction is started.

The suction speeds of the suction pump 23 are equal in the first intense suction and the second intense suction. Thus, by shortening the time for blocking the portion of the supply line K in the second intense suction compared to that of the first intense suction, the maximum negative pressure P2 of the second intense suction is lowered compared to the maximum negative pressure P1 of the first intense suction.

Further, in the first embodiment, the supply line K is blocked at a position closer to the ink cartridges (the liquid retainers) 22*a* to 22*d* than the pressure chamber 46, the upstream enlarged portion. This raises the negative pressure in the pressure chamber 46. The bubbles are (the air layer is) thus efficiently removed from the pressure chamber 46 when charging the liquid into the supply line K.

In the first embodiment, the initial filling involves the first intense suction and the second intense suction. The liquid is thus efficiently introduced into the supply line K, without wasting an excessive amount of the liquid.

Second Embodiment

Figure 7:
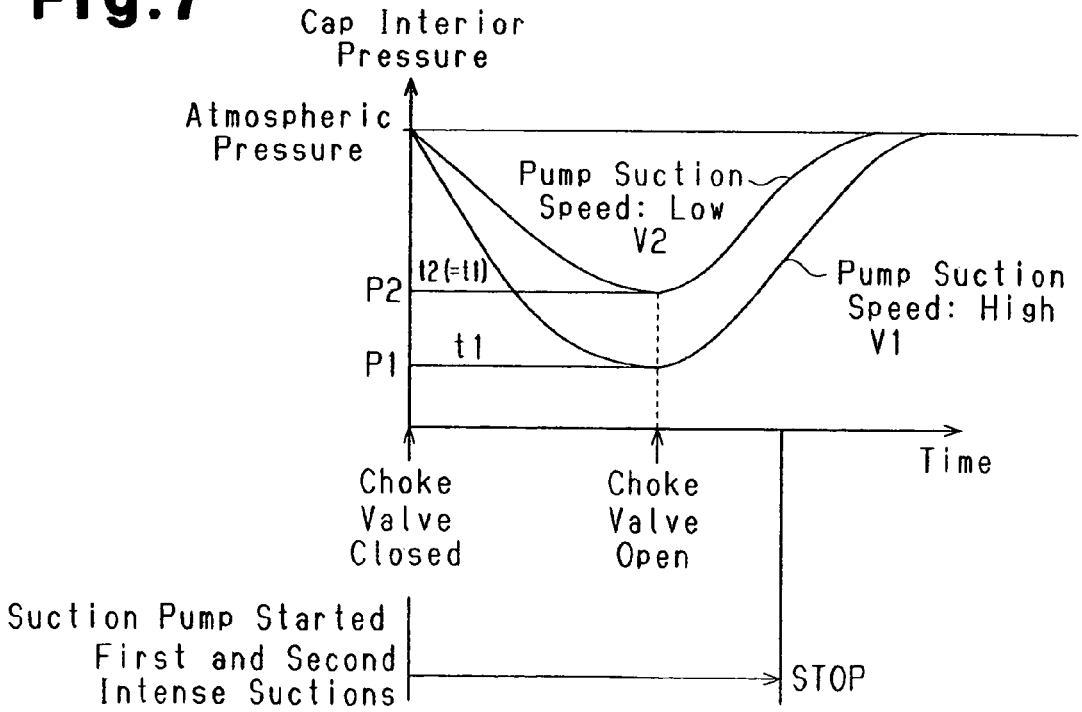
FIG. 7 is a graph representing variation of the pressure in the cap 26 and operation timings of a suction pump during first and second intense suctions according to a second embodiment.

A second embodiment of the present invention will hereafter be explained with reference to FIG. 7. The mechanical configuration of the second embodiment is identical with that of the first embodiment. Same or like reference numerals are given to parts of the second embodiment that are the same as or like corresponding parts of the first embodiment. Description thereof thus will be omitted. The second embodiment is different from the first embodiment in terms of the second intense suction.

More specifically, in the first intense suction of the second embodiment, the controller 41 controls the suction pump 23 at a suction speed V1 that is equal to that of the first intense suction of the first embodiment. The suction pump 23 is continuously operated. Contrastingly, in the second intense suction, the controller 41 controls and continuously operates the suction pump 23 at a suction speed V2 (<V1) that is lower than the speed V1 of the first intense suction.

The time (the closed-valve time) for switching the choke valve 30*a* from the closed state to the open state in the first intense suction is defined as the time t1. Similarly, the corresponding time of the second intense suction is defined as the time t2. Thus, when the time t2 elapses in the second intense suction, the negative pressure reaches the maximum negative pressure P2, which has been described in the first embodiment. The pump suction speed V2 is set in such a manner that the time t2 coincides with the time t1. Alternatively, as long as the negative pressure in the interior 61 of the cap 26 becomes the maximum negative pressure P2, the time t1 and the time t2 do not necessarily have to be equal to each other. For example, as long as the suction speed V2 is lower than the suction speed V1, the time t1 may be greater or smaller than the time t2. In these cases, when the pressure in the interior 61 of the cap 26 detected by the pressure sensor 85 reaches the maximum negative pressure P2, the controller 41 controls the ink supply pressure in such a manner as to open the choke valve 30*a*.

As has been described, in the second embodiment, the suction speed V2 of the suction pump 23 of the second intense suction is lower than the suction speed V1 of the first intense suction. The maximum negative pressure P2 of the second intense suction thus becomes smaller than the maximum negative pressure P1 of the first intense suction.

The illustrated embodiments may be modified as follows.

In the second embodiment, the suction pump 23 is continuously operated in the second intense suction in such a manner that the suction speed V2 becomes lower than the suction speed V1 of the first intense suction. However, the maximum negative pressure P2 (<P1) may be obtained in the second intense suction by intermittently actuating the suction pump 23.

As long as the maximum negative pressure P2 of the second intense suction becomes smaller than the maximum negative pressure P1 of the first intense suction through the intermittent actuation of the suction pump 23, the suction speeds of the first and second intense suctions do not necessarily have to be equal but may differ from each other. That is, the suction pump 23 may be operated at any suitable speeds as long as the maximum negative pressure P2 of the second intense suction in the second suction step becomes smaller than the maximum negative pressure P2 of the first intense suction in the first suction step.

Figure 8A:
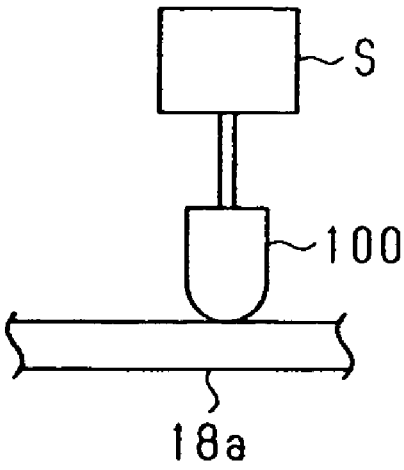
FIGS. 8(*a*) and 8(*b*) are views schematically showing a stopper member 100 of another embodiment.
Figure 8B:
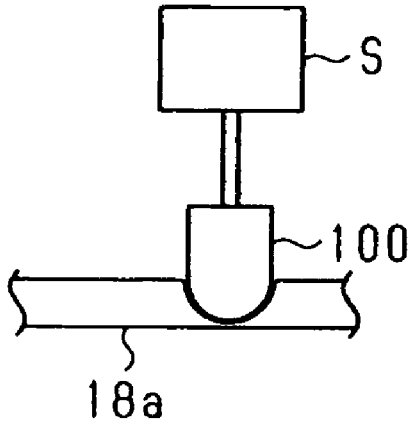

In each of the illustrated embodiments, instead of providing the choke valve 30*a*, the supply tube 18*a* extending between the pressure adjustment mechanism 17*a* and the ink cartridge 22*a* may be formed of elastic material. In this case, a stopper member 100 serving as open-close means (see FIG. 8) is provided in the exterior of the supply tube 18*a*. The stopper member 100 selectively contacts or separates from the supply tube 18*a*. The stopper member 100 is connected to a plunger of a drive source S formed by, for example, a solenoid. By moving forward or rearward together with the plunger, the stopper member 100 contacts or separates from the supply tube 18*a*, thus selectively closing and opening the supply tube 18*a*.

Further, the controller 41 may operate the drive source S at the same timings as the actuation timings of the choke valve 30*a* of the first or second embodiment. In this manner, the corresponding portion of the supply tube 18*a* is selectively opened and closed, thus correspondingly permitting or prohibiting the ink flow in the supply tube 18*a*. Also in this case, the advantages of the first or second embodiment may be obtained.

In the first and second embodiments, the first intense suction may be followed by at least the second intense suction, not the normal suction in which the suction is performed by the suction pump 23 with the supply line K held in an open state. The normal suction may be carried out before or after the second intense suction.

Regardless of whether the normal suction is performed before or after the second intense suction, the amount of the bubbles trapped in the upper filter chamber 64, the downstream enlarged portion, is reduced through the second intense suction. The liquid is thus efficiently charged into the supply line K without wasting an excessive amount of the liquid.

In the initial filling of the first embodiment, the first intense suction and the second intense suction are performed relatively soon after the normal suction. However, after the initial filling of the first embodiment (including the normal suction and the first and second intense suctions), the first intense suction and the second intense suction may be carried out at constant or non-constant time intervals.

In other words, the controller 41 may be provided with a time table for performing the first and second intense suctions. In accordance with the time table, the first and second intense suctions are performed at a time interval after the initial filling. The time table includes data about time intervals (for example, constant time intervals each corresponding to one month or non-constant time intervals) at which the first and second intense suctions should be performed. The time table may be externally rewritable and thus changed when necessary. In this case, by changing the time intervals, the ink filling may be performed as needed in correspondence with the environment of the liquid ejection apparatus.

Further, during the following time interval after the initial filling, the bubbles discharged from the liquid retainers may be trapped in the upstream enlarged portion. Also, the gas contained in the liquid may form bubbles and thus be trapped in the supply line K. In these cases, the amount of the trapped bubbles is increased. However, regardless of this, the efficient liquid filling that prevents an excessive waste of the liquid is ensured by carrying out the first and second intense suctions at certain intervals after the initial filling.

In the first and second embodiments, the second intense suction is performed relatively soon after, or sequentially with, the first intense suction. However, the second intense suction may be performed after a delay (a time interval) with respect to the first intense suction.

For example, the controller 41 may have a time table for performing the first and second intense suctions. In accordance with the time table, the controller 41 executes the second intense suction at a time interval after the first intense suction. The time table includes data about time intervals (for example, constant time intervals each corresponding to one month or non-constant time intervals) at which the second intense suction should be carried out following the first intense suction. The time table may be externally rewritable and thus changed when necessary. In this case, by changing the time intervals, the ink filling may be performed as needed in correspondence with the environment of the liquid ejection apparatus.

Also in this case, the second intense suction prevents the bubbles from being discharged from the pressure chamber 46, the upstream enlarged portion, into the upper filter chamber 64, the downstream enlarged portion. The amount of the bubbles trapped in the upper filter chamber 64 is thus reduced. The liquid is thus efficiently charged into the supply line K without wasting an excessive amount of the liquid.

In the first and second embodiments, the initial filling includes the normal suction, the first intense suction, and the second intense suction. However, the initial filling is not restricted to such combination.

For example, in the initial filling, the first intense suction may be carried out in combination with the normal suction, in which the suction pump 23 performs suction with the supply line K held in an open state. In this case, the controller 41 may perform the first intense suction before or after the normal suction.

More specifically, under the maximum negative pressure P1 of the first intense suction, the bubbles may be trapped in the pressure chamber 46, or the upstream enlarged portion, but may later escape from the pressure chamber 46. However, by combining the first intense suction and the normal suction in the initial filling, these bubbles can be discharged. Subsequently, the controller 41 performs the second intense suction at a time interval.

In each of the illustrated embodiments, the pressure adjustment mechanism 17*a* is formed as the self-sealing valve. However, the pressure adjustment mechanism 17*a* is not restricted to the self-sealing valve but may be formed as a pressure damper. The pressure damper is installed in the ejection head 14 and connected to the ink cartridge 22*a* through, for example, the communication passage 27. This supplies the ink from the ink cartridge 22*a* to the ejection head 14. Since such configuration is publicly known as described in Japanese Laid-Open Patent Publication No. 2003-211688, explanation thereof will be omitted.

The present examples and embodiments are to be considered as illustrative and not restrictive and the invention is not to be limited to the details given herein, but may be modified within the scope and equivalence of the appended claims.

What is claimed is:

1. A method for charging a liquid into a supply line defined in a liquid ejection apparatus, the supply line supplying the liquid from a liquid retainer retaining the liquid to a nozzle ejecting the liquid, the supply line including a tubular passage and a plurality of enlarged portions that communicate with the tubular passage, the liquid ejection apparatus having suction means that draws gas or liquid from the supply line through the nozzle, the method comprising:

a first suction step of performing suction by the suction means with a portion of the supply line held in a blocked state at a predetermined position, and then releasing the blocked portion of the supply line, thereby discharging a bubble from an upstream one of the enlarged portions; and a second suction step of performing the suction by the suction means, after the first suction step, with the portion of the supply line held in the blocked state at the predetermined position until obtaining a maximum negative pressure smaller than a maximum negative pressure of the first suction step in the supply line, and then releasing the blocked portion of the supply line after completing the suction by the suction means, thereby discharging a bubble from a downstream one of the enlarged portions.

2. The method according to claim 1, wherein, in the second suction step, the maximum negative pressure smaller than the maximum negative pressure of the first suction step is set by shortening the time for maintaining the portion of the supply line in the blocked state compared to that of the first suction step.

3. The method according to claim 1, wherein, in the second suction step, the maximum negative pressure smaller than the maximum negative pressure of the first suction step is set by decreasing a suction speed of the suction means compared to that of the first suction step.

4. The method according to claim 1, wherein, in the second suction step, the maximum negative pressure smaller than the maximum negative pressure of the first suction step is set by intermittently operating the suction means.

5. The method according to claim 1, wherein, in the first and second suction steps, the position at which the portion of the supply line is blocked is located in the vicinity of the liquid retainer arranged further upstream from the upstream enlarged portion.

6. The method according to claim 1, wherein, after the first suction step is completed, the second suction step is performed independently or in combination with a normal suction step in which the suction by the suction means is carried out with the supply line held in an open state.

7. The method according to claim 6, wherein the second suction step is performed at a certain time interval after the first suction step.

8. The method according to claim 7, wherein, in the initial filling in which the liquid is charged from the liquid retainer to the supply line before the initial use of the liquid ejection apparatus, the first suction step and the normal suction step in which the suction by the suction means is performed with the supply line held in the open state are executed in combination.

9. The method according to claim 1, wherein the first and second suction steps are performed at a certain time interval after an initial filling in which the liquid is charged from the liquid retainer into the supply line before an initial use of the liquid ejection apparatus.

10. A liquid ejection apparatus comprising a supply line for supplying a liquid from a liquid retainer retaining the liquid to a nozzle ejecting the liquid, an open-close device for selectively opening and closing a portion of the supply line, a suction device for drawing gas or liquid from the supply line through the nozzle, and a controller for controlling the open-close device and the suction device, the supply line including a tubular passage and a plurality of upstream and downstream enlarged portions that communicate with the tubular passage, wherein the controller performs suction at a first negative pressure by the suction device with a portion of the supply line maintained in a blocked state by the open-close device, and then releases the blocked portion of the supply line through the open-close device, and wherein the controller subsequently performs the suction by the suction device with the portion of the supply line maintained in the blocked state by the open-close device until obtaining a second negative pressure smaller than the first negative pressure, and then releases the blocked portion of the supply line through the open-close device.

* * * * *